US007738007B2

(12) United States Patent
Ichii et al.

(10) Patent No.: US 7,738,007 B2
(45) Date of Patent: Jun. 15, 2010

(54) OPTICAL SCANNING DEVICE AND METHOD FOR ADJUSTING ERRORS

(75) Inventors: Daisuke Ichii, Kanagawa (JP); Makoto Hirakawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/190,182

(22) Filed: Aug. 12, 2008

(65) Prior Publication Data

US 2009/0060582 A1 Mar. 5, 2009

(30) Foreign Application Priority Data

Sep. 4, 2007 (JP) ..... 2007-228540
May 22, 2008 (JP) ..... 2008-133780

(51) Int. Cl.
*B41J 15/14* (2006.01)
*B41J 27/00* (2006.01)

(52) U.S. Cl. ..... 347/244; 347/258

(58) Field of Classification Search ..... 347/230, 347/241–244, 256–259; 359/204.1, 210.1, 359/618, 641
See application file for complete search history.

(56) References Cited

U.S. PATENT DOCUMENTS 5,745,296 A * 4/1998 Nakamura et al. ..... 359/641
6,804,064 B2 10/2004 Hirakawa
6,816,292 B2 * 11/2004 Iizuka ..... 359/204.1
6,829,102 B2 12/2004 Ohashi et al.
6,917,376 B2 * 7/2005 Miyagawa ..... 347/258
7,218,432 B2 5/2007 Ichii et al.
2007/0002417 A1 1/2007 Hirakawa et al.
2007/0030538 A1 2/2007 Hirakawa et al.
2007/0064291 A1 * 3/2007 Kashimura ..... 359/204
2007/0211324 A1 9/2007 Sakai et al.
2007/0211325 A1 9/2007 Ichii
2007/0215800 A1 9/2007 Miyatake et al.
2007/0253047 A1 11/2007 Ichii et al.
2007/0253048 A1 11/2007 Sakai et al.
2008/0024849 A1 1/2008 Hayashi et al.
2008/0025759 A1 1/2008 Ichii et al.
2008/0055672 A1 3/2008 Watanabe et al.
2008/0055692 A1 3/2008 Saisho et al.
2008/0068690 A1 3/2008 Ichii
2008/0068693 A1 3/2008 Hayashi et al.
2008/0100895 A1 5/2008 Hayashi et al.
2008/0123159 A1 5/2008 Hayashi et al.
2008/0180772 A1 7/2008 Miyatake et al.

FOREIGN PATENT DOCUMENTS

JP 2002-287055 10/2002
JP 3445050 6/2003
JP 2005-338865 12/2005
JP 3768734 2/2006

* cited by examiner

*Primary Examiner*—Hai C Pham
(74) *Attorney, Agent, or Firm*—Oblon, Spivak, McClelland, Maier & Neustadt, L.L.P.

(57) ABSTRACT

In an optical scanning device, a lateral magnification in a direction corresponding to a sub scanning direction of an optical system is adjusted to be small by a coupling optical system that includes a first lens and a second lens. As a result, scanning by a plurality of light beams can be performed with high precision while avoiding high costs.

8 Claims, 8 Drawing Sheets

OPTICAL SCANNING DEVICE AND METHOD FOR ADJUSTING ERRORS

CROSS-REFERENCE TO RELATED APPLICATIONS

The present application claims priority to and incorporates by reference the entire contents of Japanese priority document 2007-228540 filed in Japan on Sep. 4, 2007 and Japanese priority document 2008-133780 filed in Japan on May 22, 2008.

BACKGROUND OF THE INVENTION

1. Field of the Invention

The present invention relates to an optical scanning device, a method for adjusting an error, and an image forming apparatus.

2. Description of the Related Art

Recently, there has been a demand to increase the printing speed and improve the image quality (image density) in image forming apparatuses such as laser printers and digital copiers. To cope with this demand, a new technique was developed that employs a multibeam light source, instead of a single light source. The multibeam light source emits a plurality of light beams simultaneously. To back up this new technique, various optical systems compatible with multi beams light sources have been developed.

For example, Japanese Patent No. 3445050 discloses a multibeam scanning optical device that reduces changes in F number in a sub-scanning direction in accordance with an image height produced by an incident beam onto a scan target. This has been achieved by continuously changing a curvature in a sub scanning direction from on-axis toward off-axis for both lens surfaces of a single lens.

Japanese Patent No. 3768734 discloses an optical scanning device that employs a scanning image-forming lens having a doublet lens or a multiplet lens that has at least two special surfaces on which the sub-scanning curvature changes from the optical axis of the lens toward the periphery of the lens in the main scanning direction. On at least one of the special surfaces, the change in the sub-scanning curvature is asymmetrical relative to the main scanning direction. Moreover, the sub-scanning curvature has a plurality of extreme values.

Japanese Patent Application Laid-open No. 2005-338865 discloses an optical scanning optical device that reduces changes in F number in the sub-scanning direction in accordance with an image height produced by an incident beam onto a scan target. This has been achieved by making the position of an on-axis main plane in the optical axis direction in the sub-scanning direction closer to the scan target than the position of an off-axis main plane in the sub-scanning direction, and by continuously changing a curvature in the sub scanning direction from on-axis toward off-axis.

Finally, Japanese Patent Application Laid-open No. 2002-287055 discloses an optical scanning device that includes a light source on which a plurality of light emitting elements is arranged two-dimensionally to scan the same scanning line or different scanning lines and a defecting unit that collectively scans a plurality of light beams from the light source in a main direction. The optical scanning device rotates and adjusts the light source around an optical axis, whereby an exposure energy distribution in a sub-scanning direction formed by the light beams in the same scanning substantially equals to a desirable exposure energy distribution.

A light source that has a plurality of the light emitting elements arranged one-dimensionally can adjust all the intervals between the light emitting elements in a sub-scanning direction simultaneously by rotating the light source around an optical axis direction as a rotation axis (i.e., γ-rotation). By contrast, a light source that has a plurality of light emitting elements arranged two-dimensionally in a high density such as so-called a surface-emitting laser array is advantageous for high density writing. However, the two-dimensionally arranged light emitting elements have difficulties in adjusting intervals of scanning lines on a scan target to be uniform with high precision that is to be required for obtaining high quality images by the γ-rotation because intervals between the light emitting elements do not change uniformly when γ-rotation is performed (see FIG. 12). Intervals between the light emitting elements means a center-to-center distance between two adjacent light emitting elements.

SUMMARY OF THE INVENTION

It is an object of the present invention to at least partially solve the problems in the conventional technology.

According to an aspect of the present invention, there is provided an optical scanning device that scans a scan target surface with a light beam in a main scanning direction. The optical scanning device includes a light source that includes a plurality of light emitting elements arranged in a two-dimensional array; a pre-deflector optical system that includes a plurality of optical elements arranged along a light path of the light beam emitted from the light source, the optical elements include at least one movable optical element that is movable along a light path; a deflector that deflects the light beam that has passed through the pre-deflector optical system; and a scanning optical system that focuses the light beam deflected by the deflector onto the scan target surface, wherein the movable optical element is set at a position at which an error of a lateral magnification in a direction corresponding to a sub scanning direction of an optical system including the pre-deflector optical system and the scanning optical system is reduced.

According to another aspect of the present invention, there is provided a method for adjusting a lateral magnification in a direction corresponding to a sub scanning direction and a focal point of the above optical scanning device. The method including emitting including emitting the plurality of light beams out of the light source and radiating the assessing image plane that corresponds to the scan target surface; adjusting an interval between the first optical element and the second optical element such that a beam pitch on the assessing image plane becomes a desired value; and moving the first optical element and the second optical element while keeping the interval therebetween to focus the plurality of light beams on the assessing image plane.

According to still another aspect of the present invention, there is provided a method for adjusting a lateral magnification in a direction corresponding to a sub scanning direction and a focal point of the above optical scanning device. The method including emitting including emitting the plurality of light beams out of the light source and radiating the assessing image plane that corresponds to the scan target surface; moving the first optical element in an optical axis direction to focus the plurality of light beams on the assessing image plane; and moving the second optical element in the optical axis direction such that a beam pitch on the assessing image plane becomes a desired value.

According to still another aspect of the present invention, there is provided an image forming apparatus including at least one image carrier; and at least one optical scanning device according to claim 1 that scans the image carrier by a light beam that includes an image data.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
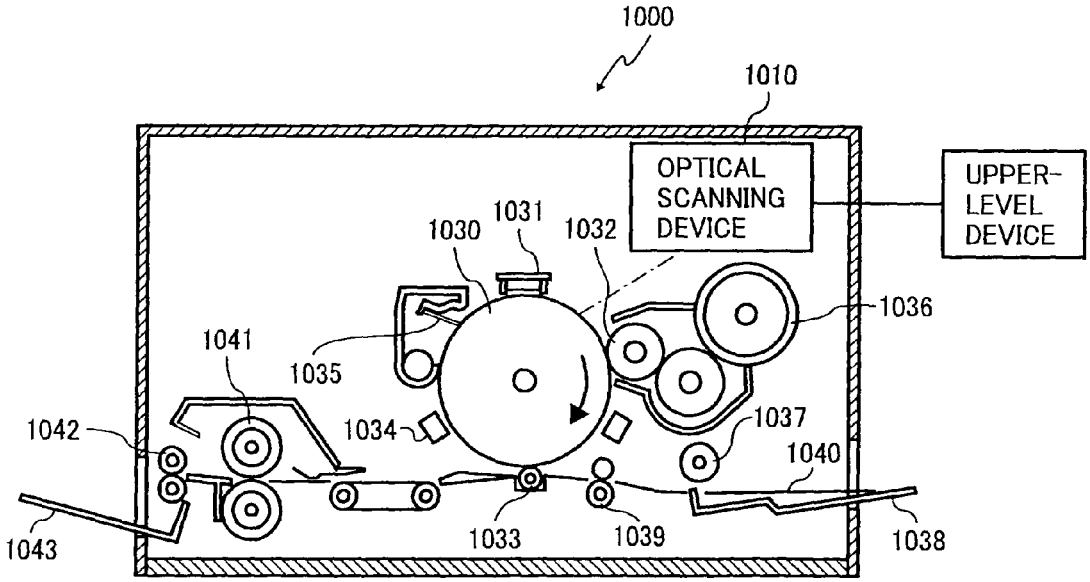
FIG. 1 is a schematic diagram of a laser printer according to an embodiment of the present invention.

FIG. 1 is a schematic configuration diagram of a laser printer 1000 as an image forming apparatus according to an embodiment of the present invention.

The laser printer 1000 includes an optical scanning device 1010, a photosensitive drum 1030, a charging unit 1031, a developing roller 1032, a transfer charger 1033, a neutralizing unit 1034, a cleaning blade 1035, a toner cartridge 1036, a sheet feed roller 1037, a sheet feed tray 1038, a pair of registration rollers 1039, a pair of fixing rollers 1041, a pair of discharge rollers 1042, and a sheet catch tray 1043.

A photosensitive layer that serves as a scan target surface is formed on a surface of the photosensitive drum 1030. The photosensitive drum 1030 rotates in clockwise direction, i.e., a direction indicated by an arrow in FIG. 1.

The charging unit 1031, the developing roller 1032, the transfer charger 1033, the neutralizing unit 1034, and the cleaning blade 1035 are arranged around the photosensitive drum 1030 in this order along the rotation direction of the photosensitive drum 1030.

The charging unit 1031 uniformly charges the surface of the photosensitive drum 1030.

The optical scanning device 1010 radiates a light beam modulated based on image data from an upper-level device, such as a personal computer (PC), on the surface of the photosensitive drum 1030 that is charged by the charging unit 1031. As a result, a latent image corresponding to the image data is formed onto the surface of the photosensitive drum 1030. The latent image is then conveyed toward the developing roller 1032 with the rotation of the photosensitive drum 1030.

Toner accommodated in the toner cartridge 1036 is supplied to the developing roller 1032. The developing roller 1032 causes the toner to adhere to the latent image to develop the latent image thereby forming a toner image. The toner image is conveyed toward the transfer charger 1033 with the rotation of the photosensitive drum 1030.

The sheet feed tray 1038 accommodates recording sheets 1040. The sheet feed roller 1037 arranged near the sheet feed tray 1038 picks up the sheets 1040 one by one from the sheet feed tray 1038, and feeds the sheet 1040 to the registration rollers 1039. The registration rollers 1039 temporarily retain the sheet 1040 and convey it to a nip between the photosensitive drum 1030 and the transfer charger 1033 in synchronization with the rotation of the photosensitive drum 1030.

The transfer charger 1033 is charged with a voltage of a polarity opposite to that of the toner. As a result, when the sheet 1040 passes between the photosensitive drum 1030 and the transfer charger 1033, the toner on the surface of the photosensitive drum 1030 is electrostatically attracted toward the sheet 1040. That is, the toner image on the surface of the photosensitive drum 1030 is transferred onto the sheet 1040. The sheet 1040 is then conveyed to the fixing rollers 1041.

The toner image is fixed onto the sheet 1040 with heat and pressure applied by the fixing rollers 1041. The sheet 1040 is then conveyed to the discharge rollers 1042 to finally be discharged onto the sheet catch tray 1043 and be successively stacked thereon.

The neutralizing unit 1034 neutralizes the surface of the photosensitive drum 1030.

The toner remaining on the surface of the photosensitive drum 1030 is removed by the cleaning blade 1035, and then the photosensitive drum 1030 returns to a position to be recharged with the charging unit 1031. The toner removed by the cleaning blade 1035 is collected in a used-toner container (not shown) for reuse.

Figure 2:
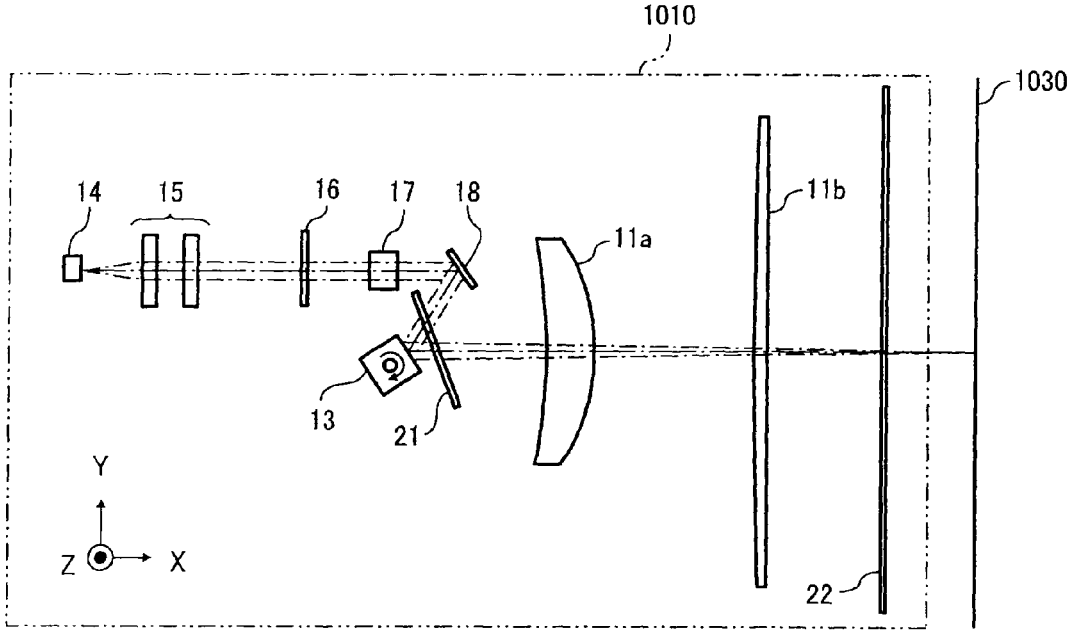
FIG. 2 is a plan view of an optical scanning device shown in FIG. 1.

As shown in FIG. 2, the optical scanning device 1010 includes a light source 14, a coupling optical system 15, an apertured plate 16, a cylindrical lens 17, a reflective mirror 18, a polygon mirror 13, a polygon motor (not shown) for rotating the polygon mirror 13, a scan lens 11*a* on a deflector side, a scan lens 11*b* on an image plane side, a scan control device (not shown), a substantially rectangular solid housing (not shown) that accommodates the above components. In a three-dimensional coordinate system having X-, Y-, Z-axis direction, a longitudinal direction of the photosensitive drum 1030 corresponds to the Y-axis direction and optical axes of the scan lenses 11*a* and 11*b* correspond to the X-axis direction.

Figure 3:
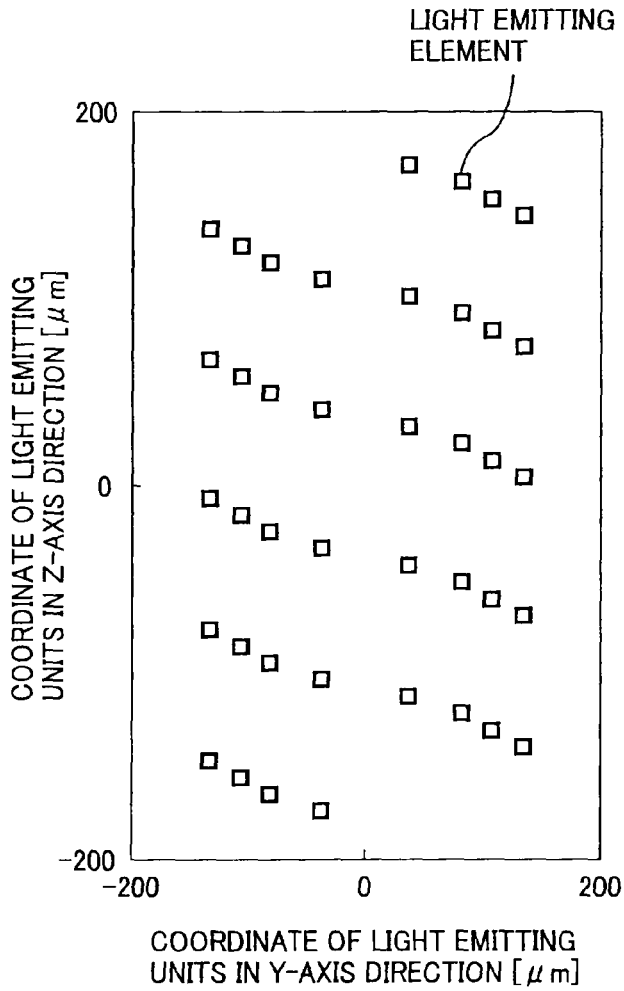
FIG. 3 is a schematic diagram of a light source shown in FIG. 2.

As shown in FIG. 3, the light source 14 includes, although not limited, 40 light emitting elements arranged on a single substrate. Each light emitting element is a vertical cavity surface emitting laser (VCSEL) that has an oscillation wavelength of 780 nanometers and emits a light beam in the X-axis direction (see FIG. 4). The VCSEL has small temperature fluctuations of the oscillation wavelength and does not generate discontinuous changes in wavelength (so-called wavelength hopping) in principle.

As shown in FIG. 2, the coupling optical system 15 converts the light beam emitted from the light source 14 into a parallel beam.

Figure 4:
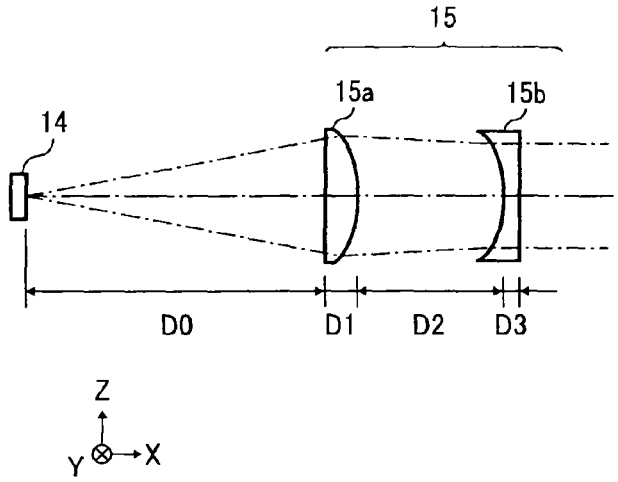
FIG. 4 is a schematic diagram of a coupling optical system shown in FIG. 2.

The coupling optical system 15 includes a first lens 15*a* and a second lens 15*b* as shown in FIG. 4.

The first lens 15*a* is made of glass and has a positive power, i.e., the curvature radius of a surface in the −X-axis direction is infinite and the curvature radius of the other surface is −22.4 millimeters. The refractive index of the first lens 15*a* is 1.5111 and a center thickness (D1 in FIG. 4) is 2.6 millimeters.

The second lens 15*b* is made of resin and has a negative power, i.e., the curvature radius of a surface in the −X-axis direction is −150 millimeters and the curvature radius of the other surface is infinite. The refractive index of the second lens 15*b* is 1.5239 and a center thickness (D3 in FIG. 4) is 3.0 millimeters.

The absolute value of power of the first lens 15*a* is $2.28\times10^{-2}$ and the absolute value of power of the second lens 15*b* of $3.5\times10^{-3}$. In other words, the absolute value of power of the first lens 15*a* is larger than that of the second lens 15*b*.

Figure 5:
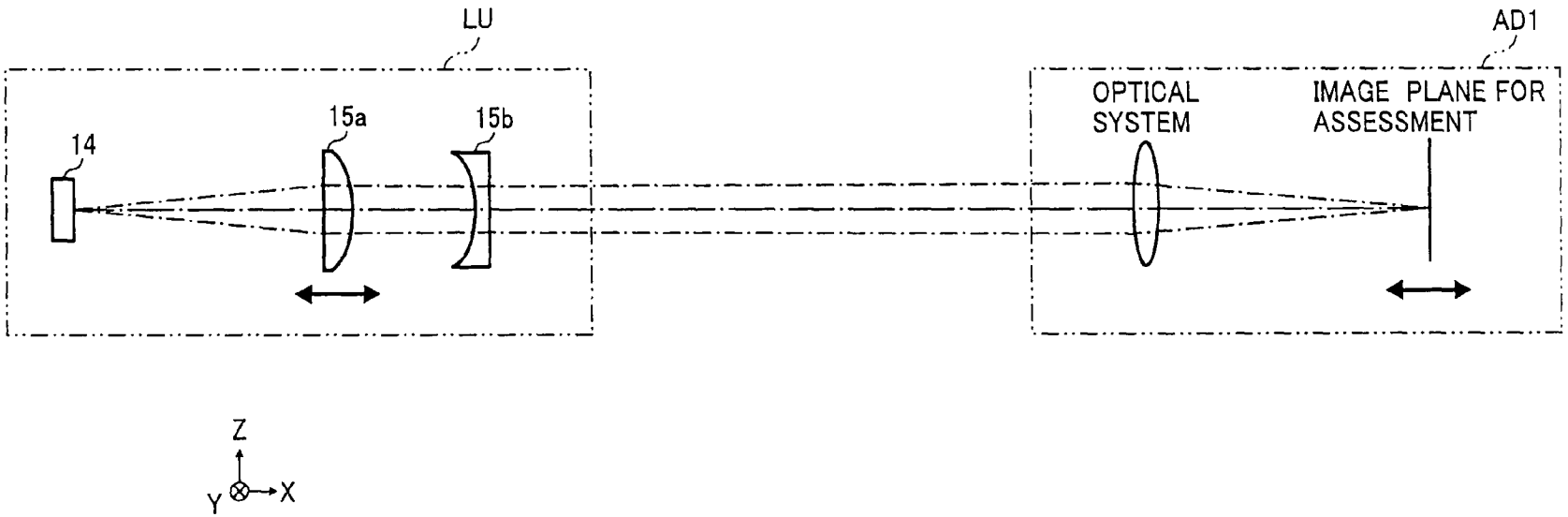
FIGS. 5 and 6 are schematic diagrams for explaining methods for adjusting the coupling optical system.

The light source 14 and the coupling optical system 15 are housed in a housing to serve as a light source unit LU (see FIG. 5).

Adjustment of the coupling optical system is performed in the following manner:

(1) The light source unit LU is set to a predetermined position relative to a light source assessment unit AD1 (see FIG. 5).

(2) The first lens 15*a* is then moved in the X-axis direction to focus light beams emitted from the light emitting elements of the light source 14 onto an image plane for assessment (hereinafter, "assessing image plane") of the light source assessment unit AD1. The focal length of the optical system in the light source assessment unit AD1 is 50 millimeters. The first lens 15*a* is moved in the X-axis direction until the light beams emitted from the light source unit LU take an appropriate form. Therefore, when the light source unit LU is used in the optical scanning device 1010, accuracy of image formation on the scan target can be improved. That is, a positional error of the focal point through the entire optical system can be kept below the desirable error level.

Figure 6:
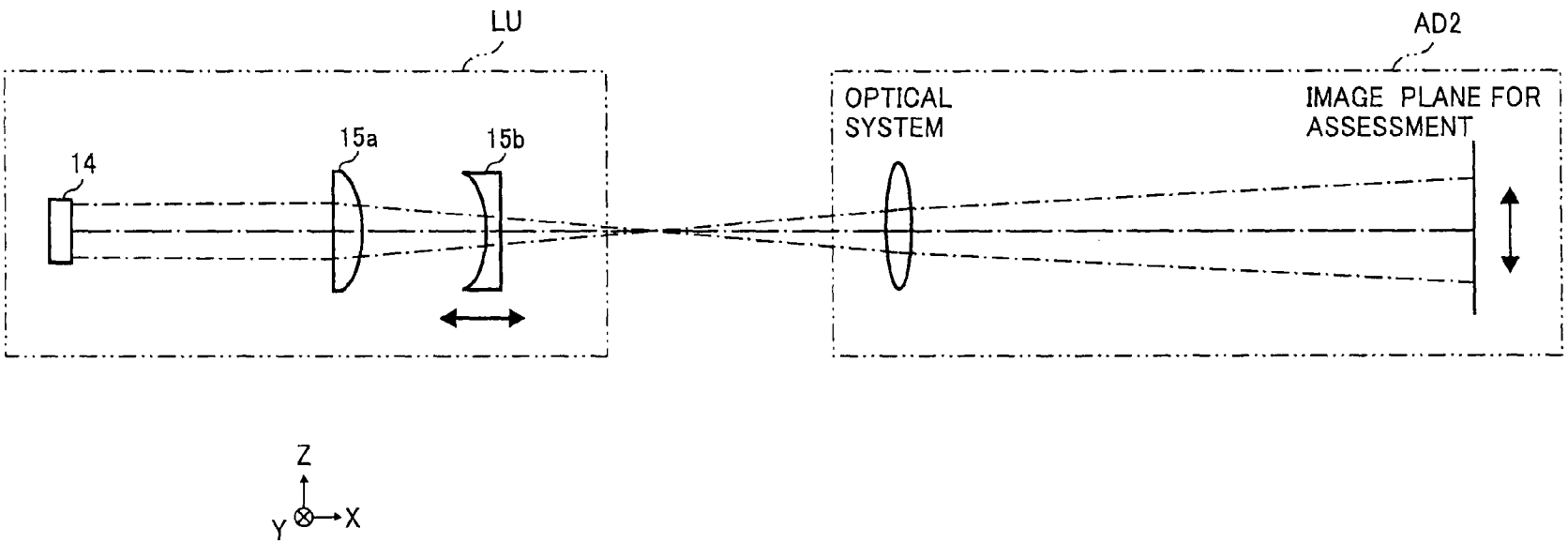

(3) The light source unit LU is set to a predetermined position relative to a light source assessment unit AD2 (see FIG. 6).

(4) Light beams are emitted from the light emitting elements of the light source 14, and the second lens 15*b* is moved in the X-axis direction such that a desirable beam pitch of the light beams can be obtained onto an assessing image plane of the light source assessment unit AD2. The focal length of the optical system in the light source assessment unit AD2 is 98.4 millimeters. A desired lateral magnification with respect to the sub-scanning direction is 2-fold. For example, when light beams are emitted from the two light emitting elements arranged with an interval of 393 nanometers therebetween in the Z-axis direction, the second lens 15*b* is moved in the X-axis direction to obtain a beam pitch of 786 nanometers on the image plane of the light source assessment unit AD2. The second lens 15*b* is moved in the X-axis direction, so that even if there are errors in curvature radius of the first and second lenses 15*a* and 15*b* that may occur, e.g., by manufacturing, a desirable composite focal length of 49.2 millimeters for the coupling optical system 15 can be obtained, whereby a pitch error on the scan target can be reduced. In other words, an error of the lateral magnification in the sub-scanning direction of the entire optical system can be kept below the desirable error level.

Such position adjustment of the second lens 15*b* can change a focal position of the entire optical system. However, because the absolute value of power of the first lens 15*a* is larger than that of the second lens 15*b*, positional fluctuations in the focal point can be kept small.

(5) Upon completion of the position adjustment of the first and second lenses 15*a* and 15*b*, they are fixed to an optical element holding unit (not shown) with an adhesive or the like.

For example, the first and second lenses 15*a* and 15*b* can be fixed to the optical element holding unit such that an ultraviolet (UV) curable resin is pre-applied to bonding surfaces of the first and second lenses 15*a* and 15*b*, which is irradiated with UV ray after the positions of the first and second lenses 15*a* and 15*b* are determined. Therefore, a high positional accuracy is obtained even if a process is simplified.

A distance D0 between the light source 14 and the first lens 15*a* shown in FIG. 4 is 51.1 millimeters, and a distance D2 between the first lens 15*a* and the second lens 15*b* shown in FIG. 4 is 12.4 millimeters.

The light source unit LU adjusted in the above manner is set to a predetermined position within the housing of the optical scanning device 1010.

The optical element holding unit, which holds the first lens 15*a* and the second lens 15*b* in a predetermined positional relation, and a light source holding unit (not shown) for holding the light source 14 are integrated into a light-source-unit holding unit, so that the light source 14 and the first and second lenses 15*a* and 15*b* are held in a predetermined positional relation.

As shown in FIG. 2, the apertured plate 16 has an opening (aperture) to determine a diameter of the light beams that has passed through the coupling optical system 15.

The cylindrical lens 17 focuses the light beams that have passed through the opening of the apertured plate 16 onto a surface near a deflecting surface of the polygon mirror 13 in a direction corresponding to the sub-scanning direction (Z-axis direction) via the reflective mirror 18.

A soundproof glass 21 is placed between the cylindrical lens 17 and the polygon mirror 13, and between the polygon mirror 13 and the scan lens 11*a*.

The optical system placed on the light path between the light source 14 and the polygon mirror 13 will be referred to as a pre-deflector optical system. The pre-deflector optical system includes, although not limited, the coupling optical system 15, the apertured plate 16, the cylindrical lens 17, and the reflective mirror 18.

The polygon mirror 13 has, although not limited, four-side mirror surfaces each of which serves as the deflecting surface. The polygon mirror 13 rotates at a constant velocity about an axis parallel to the Z-axis direction that corresponds to the sub-scanning direction, and deflects the light beams that have passed through the cylindrical lens 17.

The scan lens 11*a* is placed on the light path of the light beams deflected by the polygon mirror 13.

The scan lens 11*b* is placed on the light path of the light beams that have passed through the scan lens 11*a* on the deflector side. The light beams that have passed through the scan lens 11*b* fall onto the surface of the photosensitive drum 1030 in the form of a light spot. The light spot moves in the longitudinal direction of the photosensitive drum 1030 with the rotation of the polygon mirror 13, so that the surface of the photosensitive drum 1030 is scanned. The moving direction of the light spot is a main-scanning direction.

The optical system that is placed on the light path between the polygon mirror 13 and the photosensitive drum 1030 will be referred to as a scanning optical system. The scanning optical system includes, although not limited, the scan lens 11*a* and the scan lens 11*b*.

A glass 22 is placed between the scan lens 11*b* and the photosensitive drum 1030 to block passage of dust from the optical system to the photosensitive drum 1030.

The adjustments are made to prevent or minimize the lateral magnification error and the positional error of the focal point of the entire optical system in the direction corresponding to the sub-scanning direction by the coupling optical system 15 in the optical scanning device 1010.

The adjustment method according to the present invention is applied to the above-stated adjustment method of the coupling optical system.

In this manner, the optical scanning device 1010 includes the coupling optical system 15 that is arranged on the light path of the light beams from the light source 14. Moreover, the coupling optical system 15 is adjusted so that the lateral magnification error in the direction corresponding to the sub-scanning direction of the entire optical system is small.

According to the embodiment, the intervals between the scanning lines on the surface of the photosensitive drum 1030 can be made uniform with high accuracy without using a costly optical element. As a result, scanning by a plurality of light beams can be performed with high precision while avoiding high costs.

Figure 7:
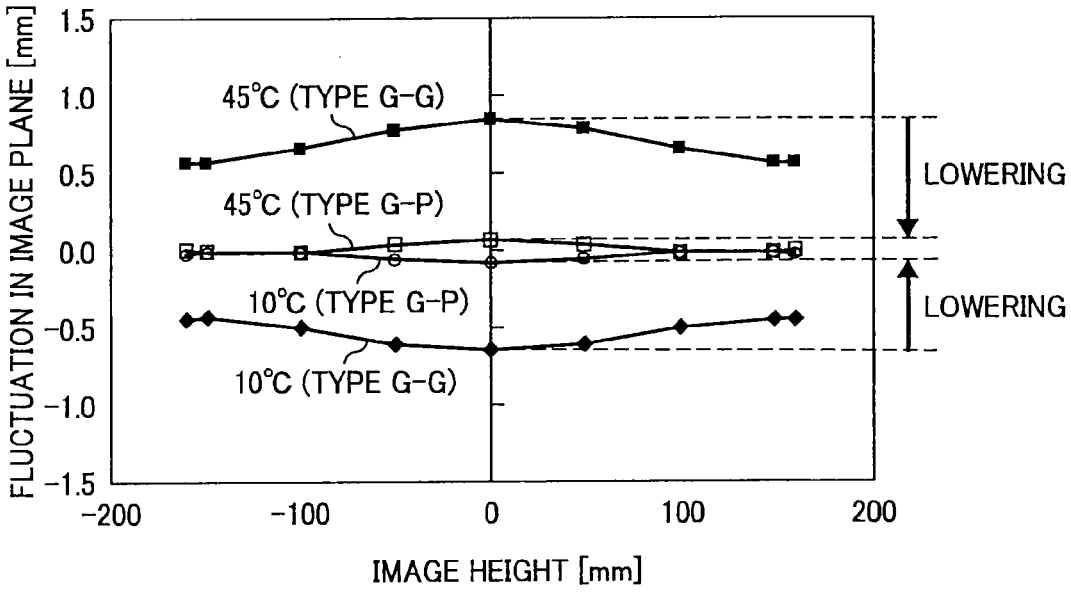
FIG. 7 is a chart showing changes in a field curvature due to temperature changes.

The first lens 15*a* is made of glass and the second lens 15*b* is made of resin (Type G-P in FIG. 7), so that the temperature-attributable fluctuations in the focal point of the entire optical system can be made small compared to the case where both of the first lens 15*a* and the second lens 15*b* are made of glasses (Type G-G in FIG. 7).

Because the light source 14 and the first and second lenses 15*a* and 15*b* are held by the light-source-unit holding unit in the predetermined positional relation, positional displacements due to assembly errors or temperature changes can be reduced. As a result, fluctuations in the optical properties (particularly, fluctuations in the focal point) and the beam pitches can be reduced.

Furthermore, because the laser printer 1000 includes the optical scanning device 1010, high quality images can be formed at low costs.

Figure 8:
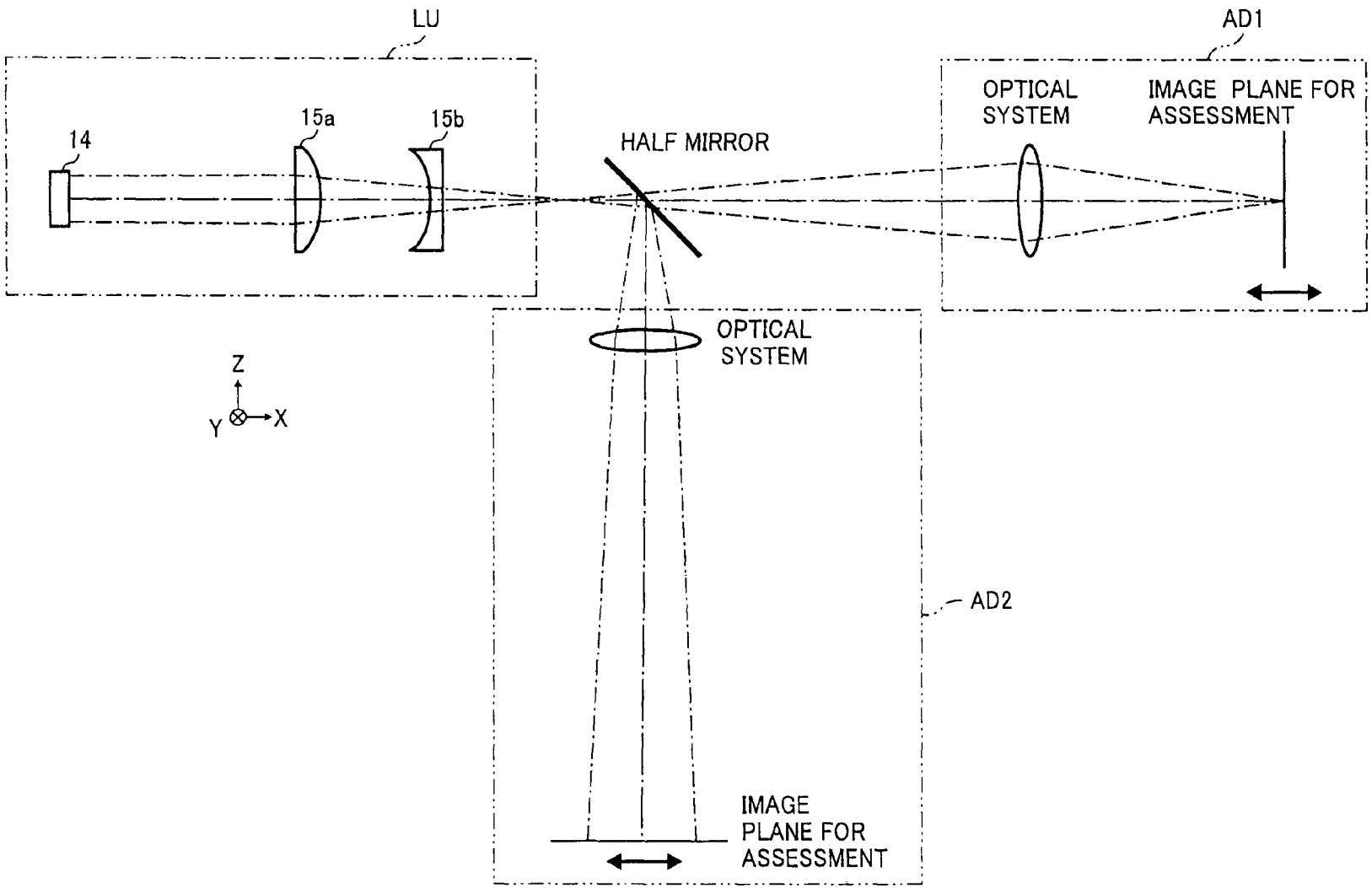
FIG. 8 is a schematic diagram for explaining a method for adjusting the coupling optical system according to a first modification.

Instead of performing the adjustment of the coupling optical system with the method explained below, the adjustment of the coupling optical system can be performed as shown in FIG. 8. Specifically, the light beams emitted from the light source unit LU can be divided by a light dividing unit, such as a half mirror, into two parts, and one part is input into the light source assessment unit AD1 and the other part is input into the light source assessment unit AD2.

Figure 9A:
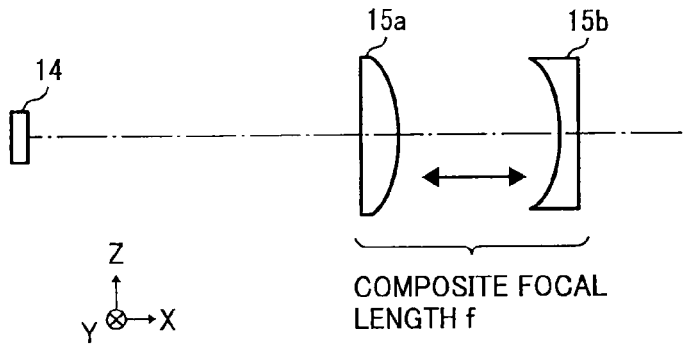
FIGS. 9A and 9B are schematic diagrams for explaining methods for adjusting the coupling optical system according to a second modification.
Figure 9B:
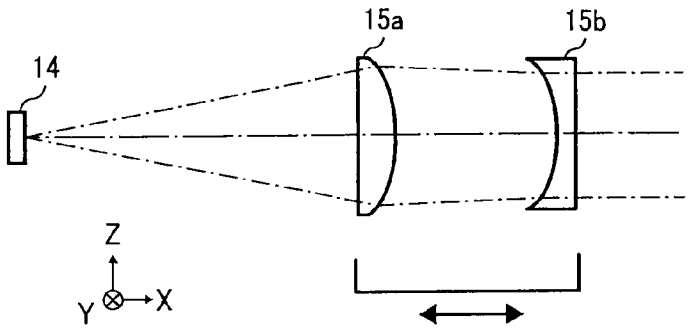
Figure 10:
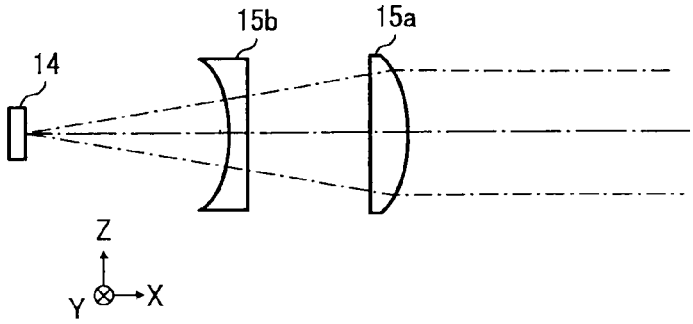
FIG. 10 is a schematic diagram for explaining a modified coupling optical system.

In the adjustment of the coupling optical system according to the embodiment, the lateral magnification in the direction corresponding to the sub-scanning direction is adjusted after completing the adjustment of the focal point, however, it is not limited thereto. For example, the distance D2 shown in FIG. 4 between the first and second lenses 15*a* and 15*b* is first adjusted as shown in FIG. 9A, and the coupling optical system 15 is moved in the X-axis direction as shown in FIG. 9B while keeping the distance D2 so that the light beams are focused onto the light source assessment unit AD1.

When moving the coupling optical system 15, the lateral magnification may change in the direction corresponding to the sub-scanning direction. However, because the absolute value of power of the first lens 15*a* is larger than that of the second lens 15*b*, the fluctuations in the lateral magnification in the direction corresponding to the sub-scanning direction are small.

In the coupling optical system 15, the first lens 15*a* is positioned closer to the light source 14 than the second lens 15*b*. Alternatively, the second lens 15*b* can be positioned closer to the light source 14 than the first lens 15*a*.

The number of the light emitting elements of the light source 14 is not limited to 40 as long as a plurality of the light emitting elements is arranged two-dimensionally.

The image forming apparatus is not limited to the laser printer 1000. In other words, the optical scanning device 1010 can be incorporated into any image forming apparatus.

For example, the optical scanning device 1010 can be incorporated into an image forming apparatus that emits laser beams directly onto a medium (e.g. a paper) that is developed by radiating laser beams.

Furthermore, the image forming apparatus can adapt a silver salt film as an image carrier. When the silver salt film is used, a latent image is formed onto the silver salt film by optical scanning, and the latent image is developed by a processing similar to a developing processing in a general silver halide photographic processing. Then, the developed latent image can be transferred onto a paper by a processing similar to a printing process in a general silver halide photographic processing. Such an image forming apparatus is usable as an optical printmaking device or an electron beam lithography for a CT scan image formation.

Moreover, in the image forming apparatuses for forming multicolor images, high quality images can be formed by utilizing optical scanning devices for color images.

Figure 11:
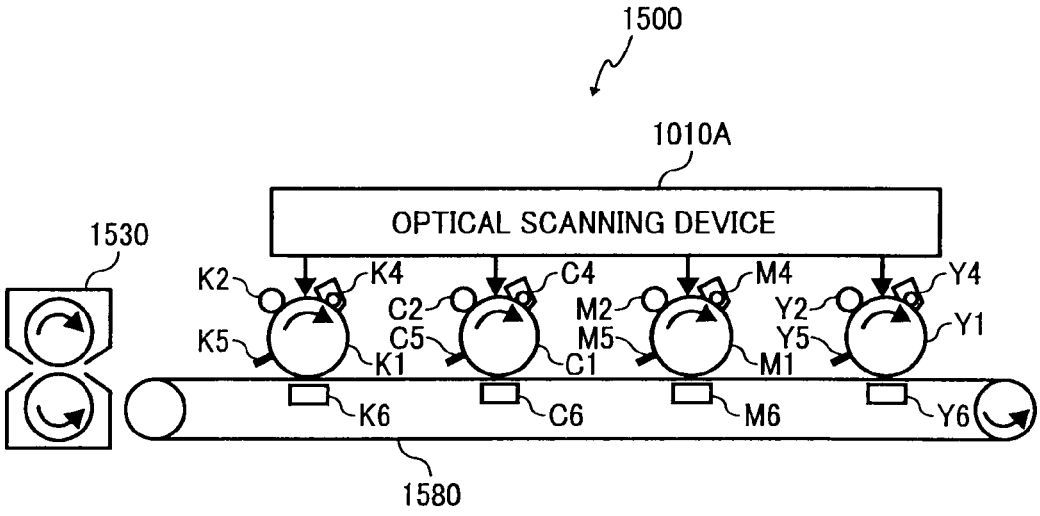
FIG. 11 is a schematic configuration of a tandem color copier.
Figure 12:
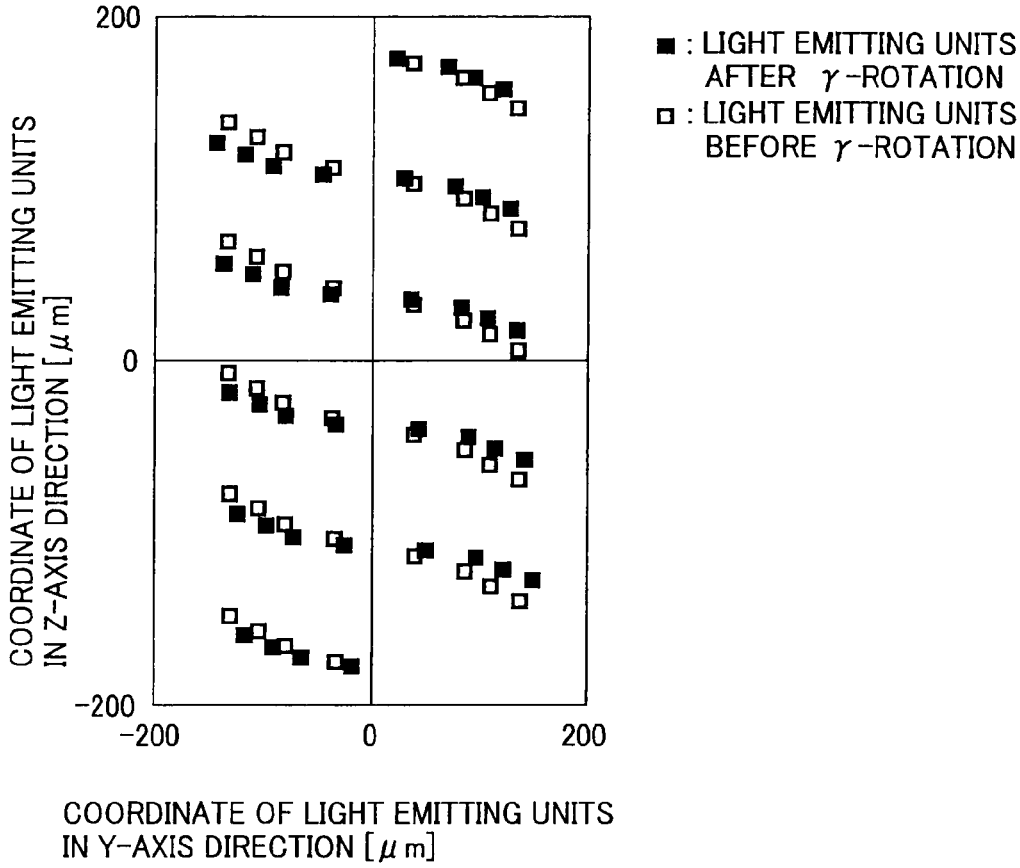
FIG. 12 is a schematic diagram illustrating emission points of the light source before and after an adjustment by γ-rotation.

As shown in FIG. 11, for example, a tandem color printer 1500 can be used, to which a plurality of photosensitive drums is provided corresponding to each of the color images. The tandem color printer 1500 includes photosensitive drums K1, C1, M1, and Y1, charging units K2, C2, M2, and Y2, developing units K4, C4, M4, and Y4, cleaning units K5, C5, M5, and Y5, and transfer charging units K6, C6, M6, and Y6 for respective colors of black, cyan, magenta, and yellow, in addition to an optical scanning device 1010A, a transfer belt 1580, and a fixing unit 1530.

The optical scanning device 1010A includes light sources for respective black, cyan, magenta, and yellow. Furthermore, the optical scanning device 1010A includes a pre-deflector optical system and a scanning optical system equivalent to those in the optical scanning device 1010 for each color. Light beams emitted from the light source for black are radiated to the photosensitive drums K1 through the pre-deflector optical system and the scanning optical system for black. In the same manner, light beams for cyan, magenta, and yellow are radiated to the respective photosensitive drums C1, M1, and Y1 through the pre-deflector optical system and scanning optical system for the respective colors.

Each photosensitive drum rotates in a direction indicated by an arrow in FIG. 11. The charging unit, the developing unit, the transfer charging unit, and the cleaning unit are arranged in this order along a rotation direction of the photosensitive drum. Each of the charging units uniformly charges the surface of the corresponding photosensitive drum. Thereafter, the optical scanning device 1010A irradiates the charged surfaces of the photosensitive drums with light beams, whereby latent images are formed thereon. The latent images are then developed by corresponding developing units, so that toner images are formed on the surfaces of the photosensitive drums. The toner images of respective color are transferred onto a recoding sheet by the corresponding transfer charging units, and finally are fixed onto the recoding sheet by the fixing unit 1530.

Because the optical scanning device 1010A includes the pre-deflector optical systems for respective light sources each equivalent to that of the optical scanning device 1010, the scanning pitches on the surface of each photosensitive drum can be uniform with high accuracy without using a costly optical element. As a result, scanning by a plurality of light beams can be performed with high precision while avoiding high costs.

Furthermore, because the tandem color printer 1500 includes the optical scanning device 1010A capable of scanning the surfaces of the photosensitive drums by a plurality of light beams without increasing the costs, the tandem color printer 1500 can form high quality images while avoiding high costs.

The tandem color printer 1500 can include black, cyan, magenta, and yellow optical scanning devices in place of the optical scanning device 1010A on the condition that the each optical scanning device includes the pre-deflector optical system equivalent to that of the optical scanning device 1010.

According to one aspect the present invention, scanning by the plurality of light beams can be performed with high precision while avoiding high costs.

According to another aspect of the present invention, the error in the focal point and in the lateral magnification in the direction corresponding to the sub-scanning direction of the entire optical system can be made below the desirable error level.

According to still another aspect of the present invention, a high quality image can be formed while avoiding high costs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical scanning device that scans a scan target surface with a light beam in a main scanning direction, the optical scanning device comprising:

a light source that includes a plurality of light emitting elements arranged in a two-dimensional array;

a pre-deflector optical system arranged along a first light path of the light beam emitted from the light source;

a deflector that deflects the light beam that has passed through the pre-deflector optical system; and a scanning optical system that focuses the light beam deflected by the deflector onto the scan target surface, wherein the pre-deflector optical system includes a first optical element that has a positive power and a second optical element that has a negative power, and the light beam emitted from the light source is incident on the first optical element, and the second optical element is arranged along a second light path of the light beam from the first optical element to the deflector, and the first and second optical elements are set at positions at which an error of a lateral magnification in a direction corresponding to a sub scanning direction of an optical system including the pre-deflector optical system and the scanning optical system is reduced, and an absolute value of power of the first optical element is larger than an absolute value of power of the second optical element.

2. The optical scanning device according to claim 1, wherein the first and second optical elements are set at a position at which a positional error of the focal point through an entire optical system is reduced.

3. The optical scanning device according to claim 1, further comprising an optical element holding unit that holds the light source, the first optical element, and the second optical element in a predetermined positional relation.

4. The optical scanning device according to claim 1, wherein the first optical element and the second optical element are made of different materials, thereby reducing temperature-attributable fluctuations in the focal point of the optical system.

5. A method for adjusting a lateral magnification in a direction corresponding to a sub scanning direction and a focal point of the optical scanning device according to claim 1, the method comprising:

emitting the plurality of light beams out of the light source and radiating the assessing image plane that corresponds to the scan target surface;

adjusting an interval between the first optical element and the second optical element such that a beam pitch on the assessing image plane becomes a desired value; and moving the first optical element and the second optical element while keeping the interval therebetween to focus the plurality of light beams on the assessing image plane.

6. A method for adjusting a lateral magnification in a direction corresponding to a sub scanning direction and a focal point of the optical scanning device according to claim 1, the method comprising:

emitting the plurality of light beams out of the light source and radiating the assessing image plane that corresponds to the scan target surface;

moving the first optical element in an optical axis direction to focus the plurality of light beams on the assessing image plane; and moving the second optical element in the optical axis direction such that a beam pitch on the assessing image plane becomes a desired value.

7. An image forming apparatus comprising:

at least one image carrier; and at least one optical scanning device that scans a scan target surface of the image carrier by a light beam that includes an image data, the optical scanning device including a light source that includes a plurality of light emitting elements arranged in a two-dimensional array;

a pre-deflector optical system arranged along a first light path of the light beam emitted from the light source;

a deflector that deflects the light beam that has passed through the pre-deflector optical system; and a scanning optical system that focuses the light beam deflected by the deflector onto the scan target surface, wherein the pre-deflector optical system includes a first optical element that has a positive power and a second optical element that has a negative power, and the light beam emitted from the light source is incident on the first optical element, and the second optical element is arranged along a second light path of the light beam from the first optical element to the deflector, and the first and second optical elements are set at positions at which an error of a lateral magnification in a direction corresponding to a sub scanning direction of an optical system including the pre-deflector optical system and the scanning optical system is reduced, and an absolute value of power of the first optical element is larger than an absolute value of power of the second optical element.

8. The image forming apparatus according to claim 7, wherein the image data is a multicolor image data.

* * * * *